US008295754B2

(12) United States Patent
Izawa et al.

(10) Patent No.: US 8,295,754 B2
(45) Date of Patent: Oct. 23, 2012

(54) TONER-FIXER APPARATUS AND ELECTRONIC PHOTOGRAPH PRINTER

(75) Inventors: Hideo Izawa, Sakura (JP); Junichi Setoyama, Yachimata (JP); Nobuyuki Kikuchi, Daisen (JP)

(73) Assignee: Miyakoshi Printing Machinery Co., Ltd. (JP)

( * ) Notice: Subject to any disclaimer, the term of this patent is extended or adjusted under 35 U.S.C. 154(b) by 554 days.

(21) Appl. No.: 12/355,037

(22) Filed: Jan. 16, 2009

(65) Prior Publication Data

US 2009/0185841 A1 Jul. 23, 2009

(30) Foreign Application Priority Data

Jan. 18, 2008 (JP) ..... 2008-009356

(51) Int. Cl.
*G03G 15/20* (2006.01)

(52) U.S. Cl. ..... 399/335

(58) Field of Classification Search ..... 399/335
See application file for complete search history.

(56) References Cited

U.S. PATENT DOCUMENTS

| | | | | |
|---|---|---|---|---|
| 4,384,783 | A * | 5/1983 | Sakata et al. | 399/156 |
| 5,126,781 | A | 6/1992 | Tomizawa et al. | |
| 5,160,963 | A | 11/1992 | Haneda et al. | |
| 2002/0145760 | A1 | 10/2002 | Ciaschi et al. | |
| 2008/0193174 | A1 | 8/2008 | Condello et al. | |

FOREIGN PATENT DOCUMENTS

| | | | |
|---|---|---|---|
| EP | 0353105 | A2 | 1/1990 |
| EP | 0435516 | A2 | 7/1991 |
| EP | 0758766 | A1 | 2/1997 |
| JP | 51-11046 | | 1/1976 |
| JP | 62-169362 | | 10/1987 |
| JP | 2-51353 | U | 4/1990 |
| JP | 8-6346 | A | 1/1996 |
| JP | 2002-296968 | A | 10/2002 |
| JP | 2003-98764 | A | 4/2003 |
| JP | 2007-11142 | A | 1/2007 |

OTHER PUBLICATIONS

Japanese Office Action for Application No. 2008-009356 with English translation mailed Nov. 24, 2009.

European Search Report for Application No. 09150699.8-1240 issued Apr. 23, 2009 received by Shiga International Patent Office on May 7, 2009.

* cited by examiner

*Primary Examiner* — David Gray
*Assistant Examiner* — Erika J Villaluna
(74) *Attorney, Agent, or Firm* — Cantor Colburn LLP

(57) ABSTRACT

A toner-fixer apparatus 1 used in an electronic photograph printer includes: an apparatus main unit extending along a web fed in the electronic photograph printer; a hot-air-blower section having air ejection ports for blowing hot air onto the web; and an air-exhaust section for suctioning air into air exhaust ports having openings on the apparatus main unit opposed to the web. In this configuration, the toner-fixer apparatus obtains capabilities in terms of fixing toner used in a multi-color image, thermal efficiency, environmental load, and space saving.

18 Claims, 6 Drawing Sheets

TONER-FIXER APPARATUS AND ELECTRONIC PHOTOGRAPH PRINTER

The present application is based on patent application No. 2008-009356 filed in Japan on Jan. 18, 2008, the content of which is incorporated herein by reference.

BACKGROUND OF THE INVENTION

1. Field of the Invention

The present invention relates to a toner-fixer apparatus used in a wet electronic photograph printer using developing solution including liquid toner and carrier liquid, and in particular, the present invention relates to a toner-fixer apparatus and an electronic photograph having the toner-fixer apparatus provided therein for fixing an image onto a sheet on a sheet-transferring path by blowing hot air thereonto.

2. Description of the Related Art

In some image-forming systems using a developing solution including liquid toner (hereinafter called simply toner) and carrier liquid, a web absorbs the carrier liquid when a toner image transferred onto an intermediate-transfer component is further transferred onto the web. In a case of forming a multi-color image by passing the web through a lot of units each having the intermediate-transfer components, the web absorbs a significant quantity of carrier liquid based on the number of colors (see, for example, Patent Document 1). Accordingly, a means for drying the web, removing the significant quantity of carrier liquid from the web, and fixing the toner thereon, is necessary.

A thermal roller method is a commonly known technique for drying the web, removing the carrier liquid absorbed in the web, and fixing the toner thereon. However, the thermal roller method has limits in time and temperature when making contact between the rolls and a printed surface. A non-contact hot-air-fixer apparatus conceived in view of this situation is disclosed in, for example, Patent Document 2. In this configuration, an image-fixing apparatus formed to extend along a web-feeding path facilitates extension of time for making contact with hot air and the web. Also, increasing the temperature of the hot air readily increases the temperature of hot air making contact with the web.

Patent Document 1: Japanese Unexamined Patent Application, First Publication No. 2007-11142

Patent document 2: Japanese Unexamined Utility Model Application, First Publication No. H02-51353

However, the aforementioned non-contact hot-air-fixer apparatus has the following problems.

(a) The aforementioned non-contact hot-air-fixer apparatus is configured to discharge hot air from many through-holes provided on a plate-shaped heater component to make the hot air contact with the web. However, air passage capability in the through-holes formed in the vicinity of the central part of hot-air-blown region (that is, the region where the heater components are arranged in line) is reduced when the contact area between the web and the hot air is expanded and the length of the apparatus is extended for extending time for making contact between the web and the hot air. Such incapability for circulating the hot air reduces thermal efficiency and causes contamination to be produced based on unevapolated components remaining in the toner absorbed in the web.

(b) Increased temperature of the hot air for improving image-fixing capability or residual heat provide wrinkle or slack on the web, thereby affecting the feed movement of the web.

(c) Extending the image-fixing apparatus in length based on the number of colors inevitably causes upsizing of the apparatus, thereby raising a problem associated with an installation space.

SUMMARY OF THE INVENTION

In view of the aforementioned inconveniences, an object of the present invention is to provide a toner-fixer apparatus and an electronic photograph printer using the toner-fixer apparatus having reliable capabilities in terms of fixing toner used in a multi-color image, thermal efficiency, environmental load, and space saving.

In order to achieve the aforementioned object, the present invention provides a toner-fixer apparatus, used in a wet electronic photograph printer using developing solution including liquid toner and carrier liquid, which includes: an apparatus main unit extending along a web fed by the electronic photograph printer; a hot-air-blower section having air ejection ports for blowing hot air therefrom onto the web; and an air-exhaust section having air exhaust ports having openings opposed to the web fed in the apparatus main unit and suctioning air.

The present invention further provides the toner-fixer apparatus in which the air ejection ports and the air exhaust ports are located at a plurality of points opposed to the web fed in the apparatus main unit.

The present invention further provides the toner-fixer apparatus in which the hot-air-blower section includes: an enclosure; air-supply pipings provided in the enclosure; heaters for heating air supplied into the enclosure from the air-supply piping; and a plurality of hot-air-blower units provided in the apparatus main unit for blowing hot air onto the web from the air ejection ports having the openings on the enclosure, so that the air-exhaust section suctions air through the air exhaust ports having a slit-shape formed among the hot-air-blower units provided in the apparatus main unit.

The present invention further provides the toner-fixer apparatus which further includes two web-guiding rolls, disposed in the vicinity of two ends of the longitudinal length of the apparatus main unit so that the roll disposed downstream relative to the apparatus main unit in a direction for feeding the web has at least a cooling apparatus for cooling the roll.

The present invention further provides the toner-fixer apparatus which further includes a support shaft for rotatably supporting the apparatus main unit of the electronic photograph printer so that the apparatus main unit can be rotated against the web.

The present invention further provides an electronic photograph printer which includes the aforementioned toner-fixer apparatus.

The present invention further provides the electronic photograph printer which further includes vertical multi-staged electronic-photograph-printing units for conducting printing operations onto the web so that the web passed through the vertical multi-staged electronic-photograph-printing unit and fed in vertical direction has a downstream section from which the feeding direction of the web is reversed, and the toner-fixer apparatus is disposed along the web so that the downstream section of the web is introduced into the toner-fixer apparatus.

EFFECT OF THE INVENTION

The hot air blown by the hot-air-blower section through the air ejection ports onto the web can be exhausted by the air exhaust section smoothly from between the apparatus main unit and the web since the toner-fixer apparatus according to the present invention has an air-exhaust section for suctioning air from the air exhaust ports having openings on the apparatus main unit opposed to the web.

Consequently, reliable air convention between the apparatus main unit and the web and reliable thermal efficiency provide time-saving and effective removal for the dried carrier liquid from the web and toner-fixing capability. The electronic photograph printer can maintain clean condition therein since the air-exhaust section capable of collecting the evaporated component of toner can prevent the condensation of the evaporated component.

The reliable air convention between the apparatus main unit and the web and the reliable thermal efficiency can provide a reliable toner-fixing capability without setting a significantly high temperature of the hot air. This prevents residual heat from providing wrinkle or slack on the web. Inconvenient and instable feed movement of the web which may be caused by the wrinkle or the slack will hardly occur, thus, the feed movement for the web can be stable.

The toner-fixer apparatus can be downsized for saving space easily. Consequently, this facilitates reducing of the size of the electronic photograph printer having the toner-fixer apparatus.

DETAILED DESCRIPTION OF THE INVENTION

An example of a toner-fixer apparatus and an electronic photograph printer as an implementation of the present embodiment will be explained as follows with reference to drawings.

Figure 1:
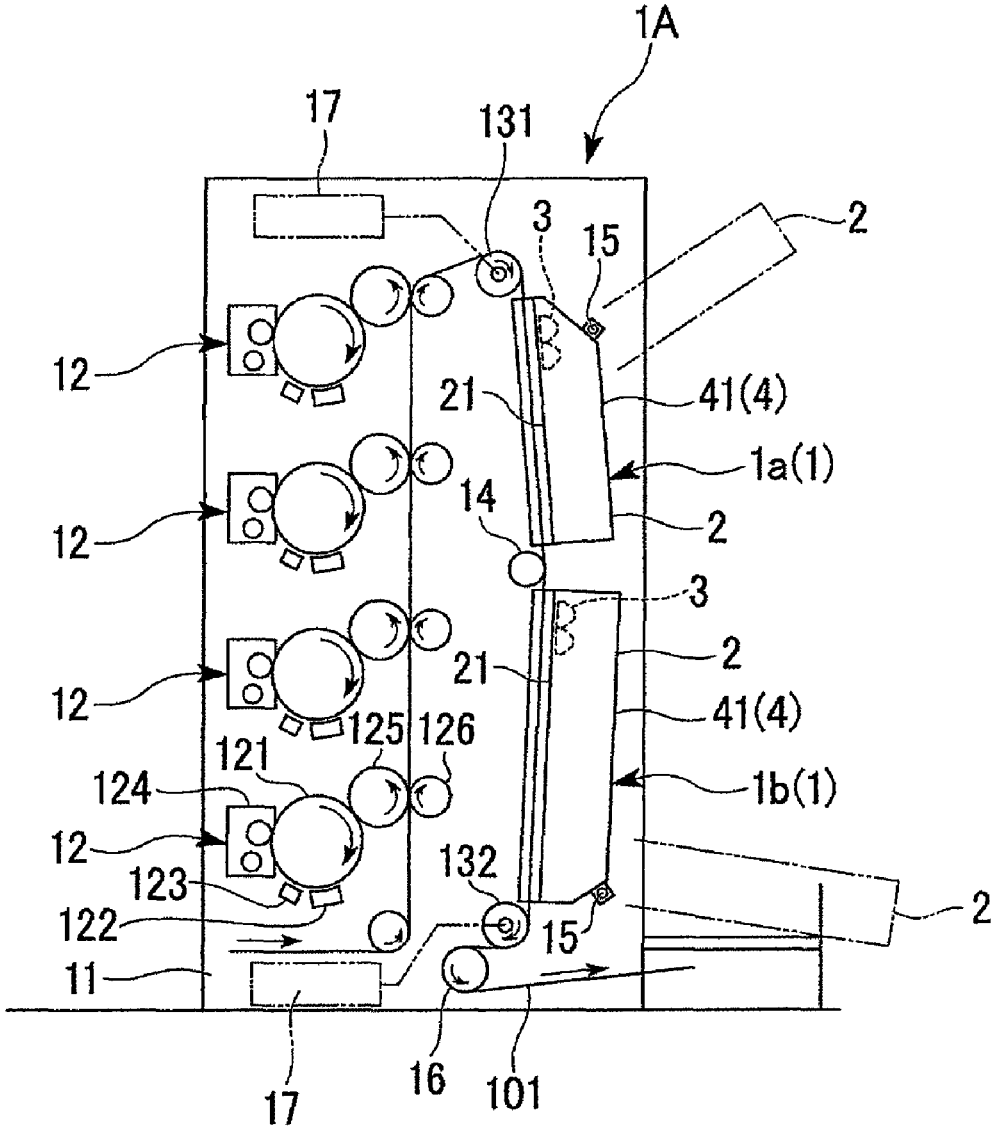
FIG. 1 is a front elevation showing an electronic photograph printer adopting a toner-fixer apparatus according to the present invention.
Figure 2:
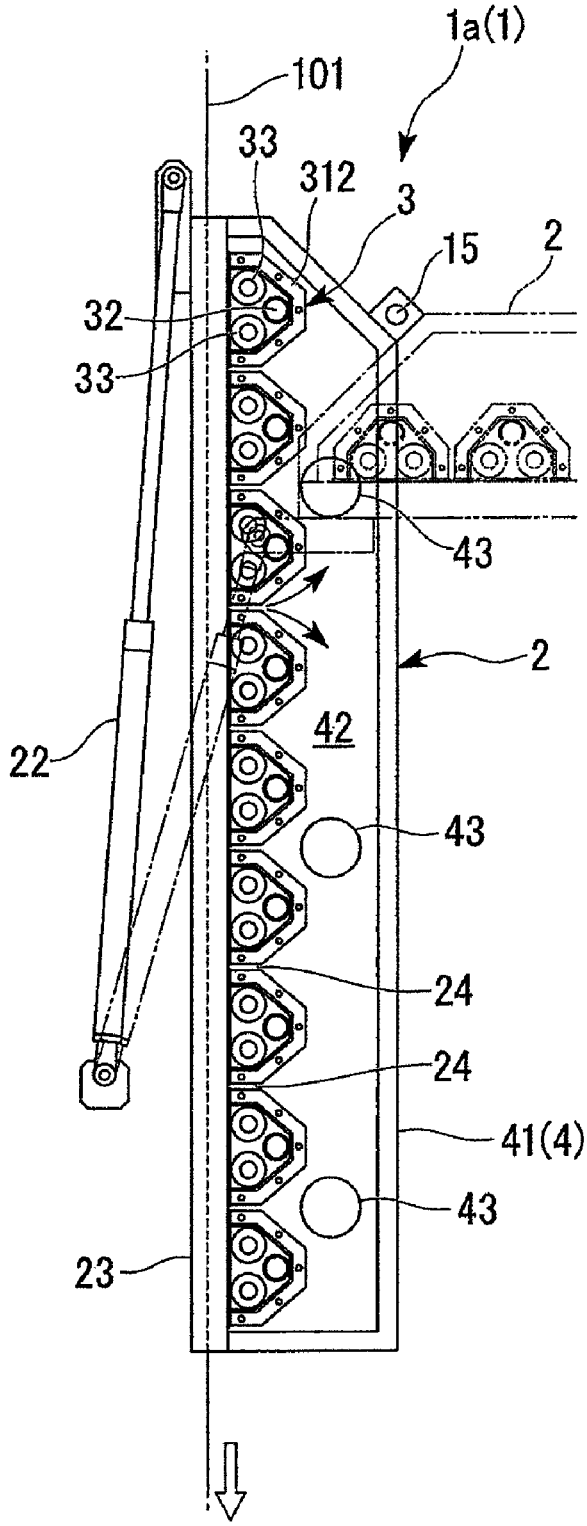
FIG. 2 is a front elevation in cross section showing the configuration of an apparatus main unit of the toner-fixer apparatus.
Figure 3:
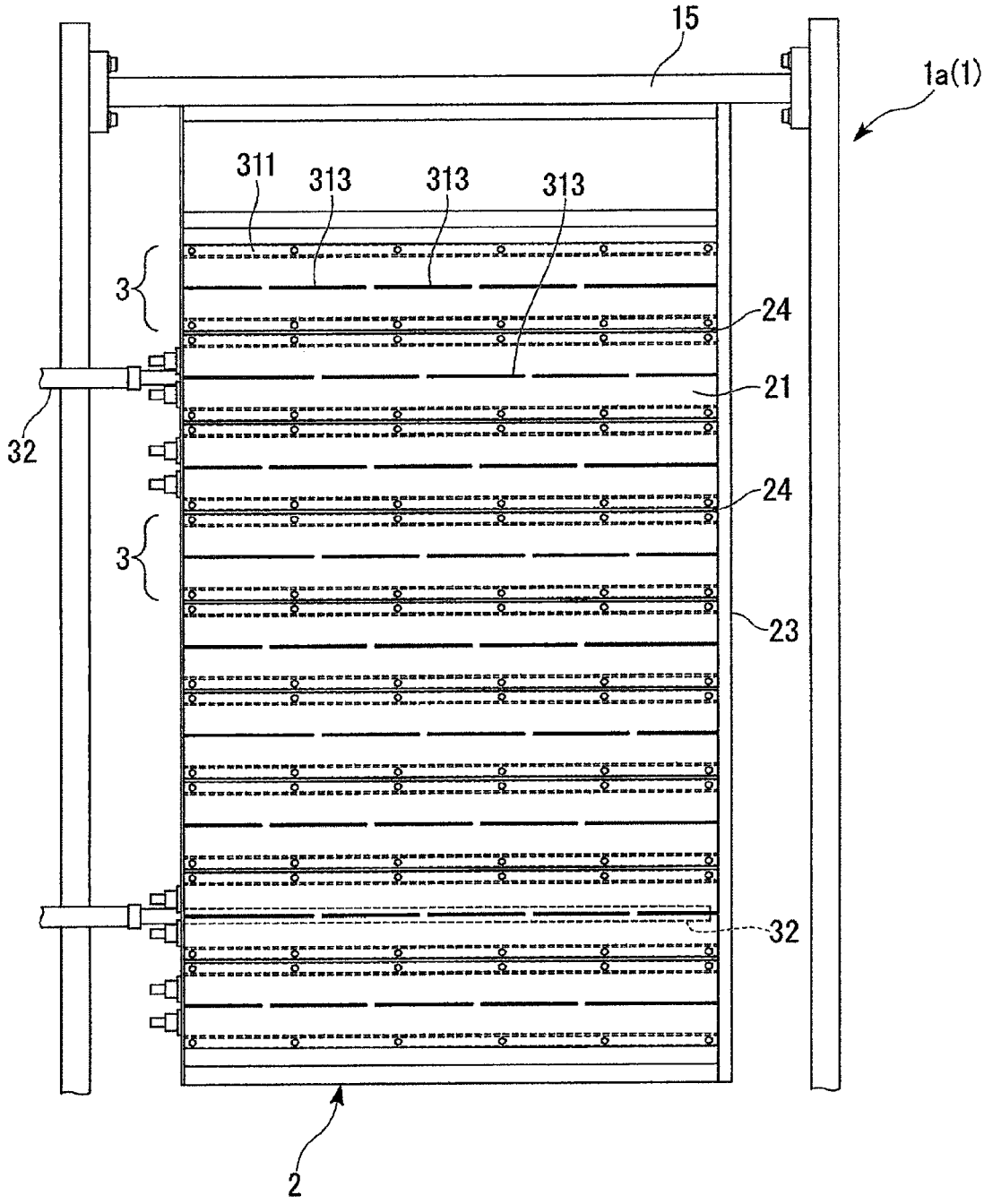
FIG. 3 is a front elevation showing the web running vertically in the apparatus main unit. Hereinafter, this view indicates a web-opposing plane 21.
Figure 4:
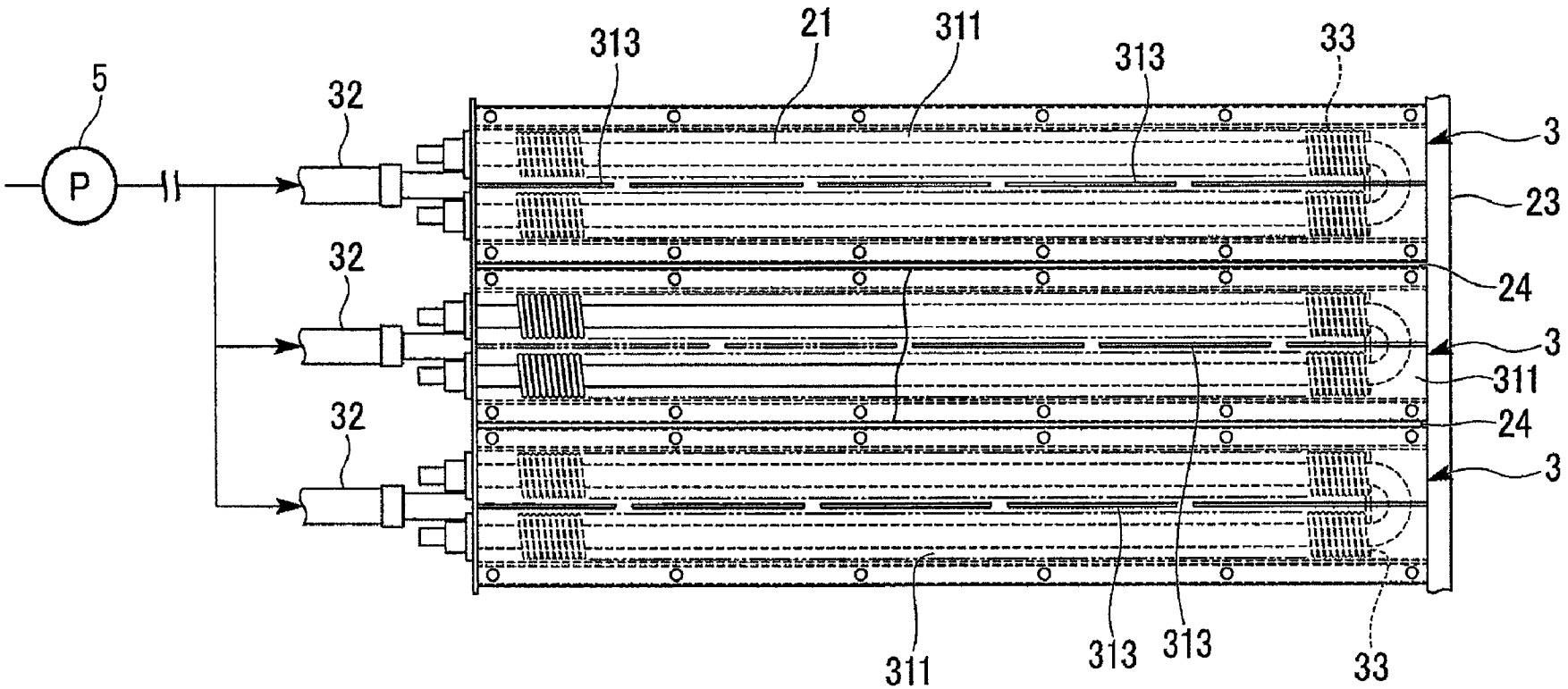
FIG. 4 is a fragmentary enlarged view of FIG. 3.
Figure 5:
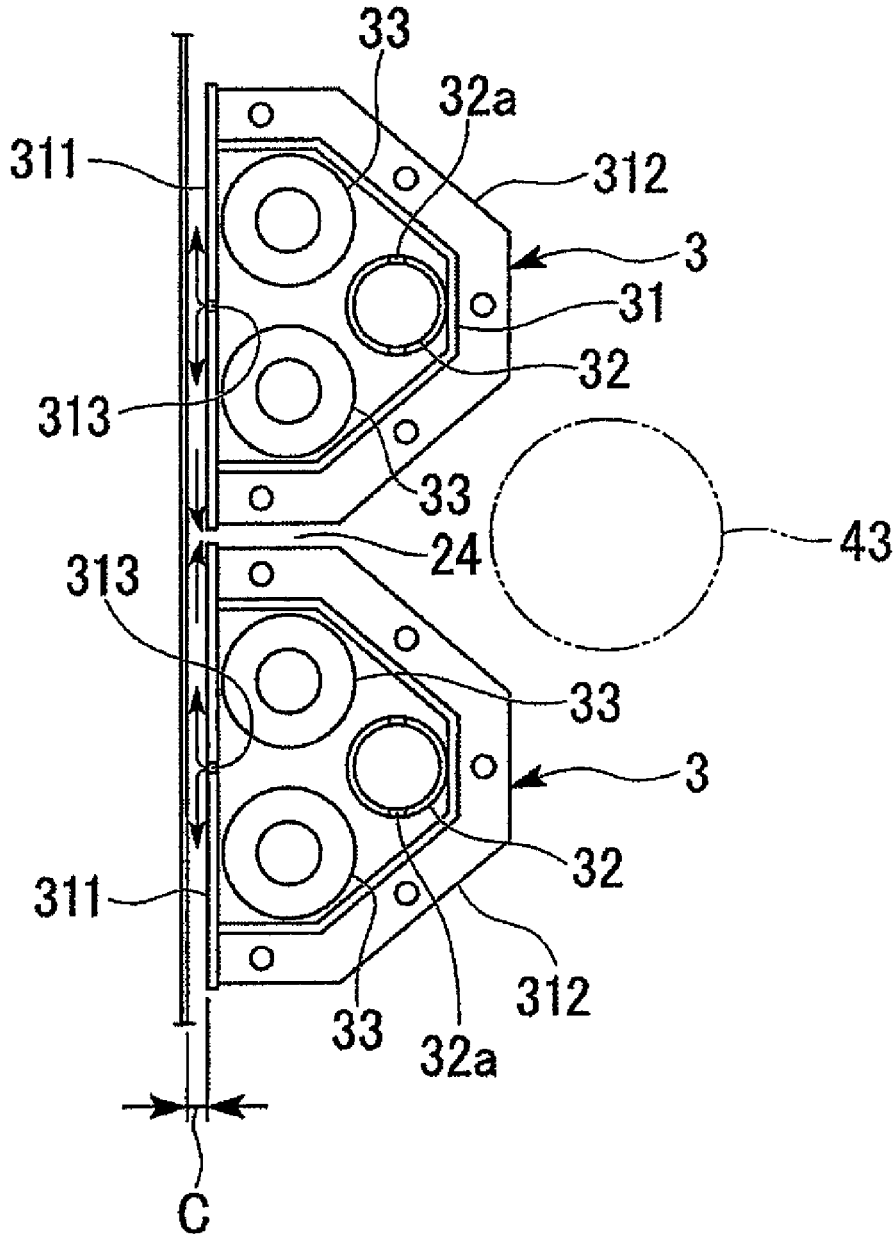
FIG. 5 is an enlarged view of the hot-air-blower section provided in the apparatus main unit.

FIG. 1 is a front elevation showing an electronic photograph printer 1A adopting a toner-fixer apparatus 1 according to the present invention. FIG. 2 is a front elevation in cross section showing the configuration of an apparatus main unit 2 of the toner-fixer apparatus 1. FIG. 3 is a front elevation showing the web running vertically in the apparatus main unit. Hereinafter, this view indicates a web-opposing plane 21. FIG. 4 is a fragmentary enlarged view of FIG. 3. FIG. 5 is an enlarged view of the hot-air-blower unit 3 provided in an apparatus main unit 2.

The following explanation is based on the precondition that, in FIGS. 1 to 5, components shown in an upper section of the drawing is disposed at a somewhat distant location from a floor line, and components shown in a lower section of the drawing is disposed on the floor or close to the floor line.

The electronic photograph printer 1A as shown in FIG. 1 includes vertical multistaged (in the drawings, four-staged) electronic-photograph-printing units 12 for conducting multi-color printing, and the toner-fixer apparatus 1 for blowing hot air onto a web 101 having undergone the multi-color printing through the electronic-photograph-printing units 12 and for fixing the toner on the web 101.

Reference numeral 11 shown in FIG. 1 indicates a frame of the electronic photograph printer 1A.

Each electronic-photograph-printing unit 12 is a wet electronic-photograph-printing apparatus using a developing solution including liquid toner and carrier liquid.

Each electronic-photograph-printing unit 12 is configured to include: a photosensitive drum 121; a static-charging apparatus 122 for statically charging the surface of the photosensitive drum 121 uniformly; an exposure apparatus 123 for forming a static latent image by removing the charges statically charged by the static-charging apparatus 122 onto the surface of the photosensitive drum 121 by using exposure light; a developer apparatus 124 for supplying the developing solution onto the photosensitive drum 121 and forming a toner image on the surface of the photosensitive drum 121 by visualizing the static latent image; a rotatable transfer roll 125 making contact with the photosensitive drum 121 for transferring the toner image from the surface of the photosensitive drum 121 to the web 101; and a backup roll 126 for pressing the web 101 to the transfer roll 125.

Each electronic-photograph-printing unit 12, vertically multi-staged in the electronic photograph printer 1A, uses a different printing color from the colors used in the other electronic-photograph-printing units 12.

Moving and feeding a swathe of the elongated recording paper 101 in the longitudinal direction (in the drawing, from an electronic-photograph-printing unit 12 in the lowest stage to an electronic-photograph-printing units 12 in the highest stage) in the electronic photograph printer IA through the vertical multi-staged electronic-photograph-printing units 12 provide multi-color printing onto the web 101.

Firstly, among the vertical multi-staged electronic-photograph-printing units 12, the web 101 is fed from the electronic-photograph-printing unit 12 that is located the most downstream in the feeding direction of the web 101 (in the drawing, the electronic-photograph-printing units 12 in the highest stage). The web 101 is introduced in the reverse direction (downward from an upper roll 131) through the vertical multi-staged electronic-photograph-printing units 12 via rolls 131 and 132 vertically separated in the electronic photograph printer 1A. Accordingly, the toner-fixer apparatus 1, provided between the vertically-arranged rolls 131 and 132, fixes the toner.

Reference numeral 16 in the drawing indicates a tension roll for applying tension onto the web 101 that is fed from the lower roll 132 toward downstream in the feeding direction.

The toner-fixer apparatus 1 will be explained as follows.

The electronic photograph printer 1A shown in the drawing has two toner-fixer apparatuses 1 vertically located between the vertically-arranged rolls 131 and 132. Hereinafter, reference symbol 1*a* indicates the upper one of the toner-fixer apparatuses 1, and reference symbol 1*b* indicates the lower one.

FIGS. 2 to 5 illustrate the construction of the upper toner-fixer apparatus 1*a*. It should be noted that the vertically located toner-fixer apparatuses 1*a* and 1*b* each have the apparatus main unit 2 having similar mechanism. The apparatus main unit 2 of the lower toner-fixer apparatus 1*b* has more number of hot-air-blower units 3 (explained later in detail) than those equipped to the apparatus main unit 2 of the upper toner-fixer apparatus 1*a*. It should be noted that the number of the hot-air-blower units 3 equipped to the apparatus main units 2 provided to the vertically located toner-fixer apparatuses 1*a* and 1*b* can be set arbitrarily.

As shown in FIG. 2, the toner-fixer apparatus 1 includes the apparatus main unit 2 having the hot-air-blower section 3 for blowing hot air onto the web 101; and an air-exhaust section 4 for suctioning air.

Each apparatus main unit 2 extends vertically (as shown in FIGS. 1 to 5) along a section of the web 101 that is fed between the vertically-arranged rolls 131 and 132.

The web-opposing plane 21 (see FIG. 5) of each apparatus main unit 2 is configured to be disposed along the web 101 fed between the vertically-arranged rolls 131 and 132. Each apparatus main unit 2 is disposed to be opposed against the web 101 so that a minute clearance C (see FIG. 5) is disposed between the web-opposing plane 21 and the web 101.

In addition, reference numeral 14 indicates a tension roll for applying tension onto the web 101 between the vertically-arranged rolls 131 and 132.

The apparatus main unit 2 of the upper toner-fixer apparatus 1*a* is disposed above the tension roll 14, and the apparatus main unit 2 of the lower toner-fixer apparatus 1*b* is disposed beneath the tension roll 14.

As shown in FIGS. 1 and 2, each apparatus main unit 2 of the toner-fixer apparatus 1 is supported by a support shaft 15 so that the apparatus main unit 2 is rotatable with respect to the frame 11 of the electronic photograph printer 1A, and so that the apparatus main unit 2 can move away from the web 101. As shown in the drawing, this movement allows the apparatus main unit 2 to be retracted in the exterior of the frame 11 of the electronic photograph printer 1A. This facilitates maintenance etc. for the apparatus main unit 2.

The apparatus main unit 2 retracted in the exterior of the electronic photograph printer 1A (hereinafter, this indicates an open state of the apparatus main unit 2) can be returned to a closed state in which the rotation around the support shaft 15 allows the web-opposing plane 21 to be along the web 101 fed between the vertically-arranged rolls 131 and 132. That is, the rotation of the apparatus main unit 2 around the support shaft 15 allows the apparatus main unit 2 to open or close.

In addition, a damper 22 attached to the apparatus main unit 2 prevents rapid movement of the apparatus main unit 2.

In the electronic photograph printer 1A having the vertically located toner-fixer apparatuses 1*a* and 1*b* as shown in the drawings, the support shaft 15 rotatably supports an upper end section (in the closed state) of the apparatus main unit 2 of the upper toner-fixer apparatus 1*a*, and the support shaft 15 rotatably supports a lower end section (in the closed state) of the apparatus main unit 2 of the lower toner-fixer apparatus 1*b*.

It should be noted that the present invention, not limited to the configuration in which the rotative movement of the apparatus main unit 2 around the support shaft 15 allows the apparatus main unit 2 to open or close, may include a rotation-free configuration in which the apparatus main unit 2 is fixed in the aforementioned closed state. The toner-fixer apparatus 1 maintains the apparatus main unit 2 in the closed state when the electronic photograph printer 1A is in a printing operation. Hereinafter, explanations associated with the apparatus main unit 2 of the present specification are based on the closed state of the apparatus main unit 2.

More specifically, as shown in FIGS. 2 and 3, each hot-air-blower section 3 of the apparatus main unit 2 has an elongated cylindrical enclosure 31 which accommodates an air-supply piping 32 and a heater 33 therein. Hereinafter, the hot-air-blower section 3 may be alternatively called a hot-air-blower unit.

Each one of serially arranged hot-air-blower units 3 disposed in a plurality of points (the apparatus main unit 2 has nine points as shown in FIGS. 2 and 3) along the apparatus main unit 2, in other words, in the feeding direction of the web 101 between the rolls 131 and 132.

Reference numeral 23 indicates the frame of the apparatus main unit 2. Each hot-air-blower unit 3 is fixed onto the frame 23.

As shown in FIG. 3, plates 311, (hereinafter, an air ejection plate, see FIG. 5 for detail.) each forming a part of the enclosure 31 of the hot-air-blower unit 3, are serially arranged in the vicinity of the web-opposing plane 21 of the apparatus main unit 2. Each air ejection plate 311 of the hot-air-blower unit 3 forms a part of the web-opposing plane 21, more specifically, the outer periphery of the air ejection plate 311 in the enclosure 31 forms a part of the web-opposing plane 21 of the apparatus main unit 2.

A swath of the air ejection plate 311 has an elongated shape. An elongated cylindrical enclosure 31 of the hot-air-blower unit 3 is formed along the longitudinal length of the air ejection plate 311. The longitudinal direction of the hot-air-blower unit 3 provided to the apparatus main unit 2 is orthogonal to the direction of the apparatus main unit 2 extending on the web-opposing plane 21.

In this configuration, the enclosure 31 of the hot-air-blower unit 3 has a cover unit 312, for accommodating the air-supply piping 32 and the heaters 33, attached thereto and opposed to the web-opposing plane 21 of the air ejection plate 311. The cross section of the cover unit 312, for preventing the air supplied into the enclosure 31 through the air-supply piping 32 from leaking, is limited not to a channel shape or an angular shape as long as the cover unit 312 has an air ejection port 313, which will be explained later, for discharging air to the exterior of the enclosure 31, and as long as a space for accommodating the air-supply piping 32 and the heaters 33 between the cover unit 312 and the air ejection plate 311 can be obtained.

As shown in FIGS. 3 and 4, the air-supply piping 32 and the heaters 33 accommodated in the enclosure 31 extend over the longitudinal length of the enclosure 31.

The air-supply piping 32 connected to the air pump 5 supplies air supplied from the air pump 5 into the enclosure 31 through an air-supply hole 32*a* (see FIG. 5) having an opening on the outer periphery of the air-supply piping 32.

The heaters 33 disposed in the hot-air-blower unit 3 heats the air supplied through the air-supply piping 32 into the enclosure 31. The hot-air-blower unit 3 discharges the heated air existing in the enclosure 31 from the air ejection port 313, which passes through the air ejection plate 311 and has the opening on the web-opposing plane 21, by using pressure for supplying air into the enclosure 31 through the air-supply piping 32. The heated and discharged air is further blown onto the web 101. Blowing hot air onto the web 101 and removing the carrier liquid from the dried web 101 provide toner-fixing treatment.

In the hot-air-blower unit 3 as shown in FIG. 4, the air ejection port 313 is a slit extending along the longitudinal length of the air ejection plate 311. Hereinafter, the air ejection port 313 illustrated in FIG. 4 may alternatively be called the slit.

The slit 313 is formed at a plurality of points on a line virtually defined along the longitudinal direction of the air ejection plate 311. Existing among the adjacent air ejection ports 313 are non-cut sections of the air ejection plate 311 that are not separated by the slits 313.

In addition, the air ejection ports 313 of the air ejection plates 311 are in staggered arrangement in the apparatus main unit 2. More specifically, the air ejection ports 313 of a hot-air-blower unit 3 are formed to correspond to the non-cut sections of an air ejection plate 311 of another adjacent hot-air-blower unit 3 with respect to the extending direction of the apparatus main unit 2.

This allows the full surface of the web 101 fed along the web-opposing plane 21 of the apparatus main unit 2 to receive the hot air uniformly, thereby enabling removal of the dried carrier liquid and uniform toner-fixing treatment.

Figure 6:
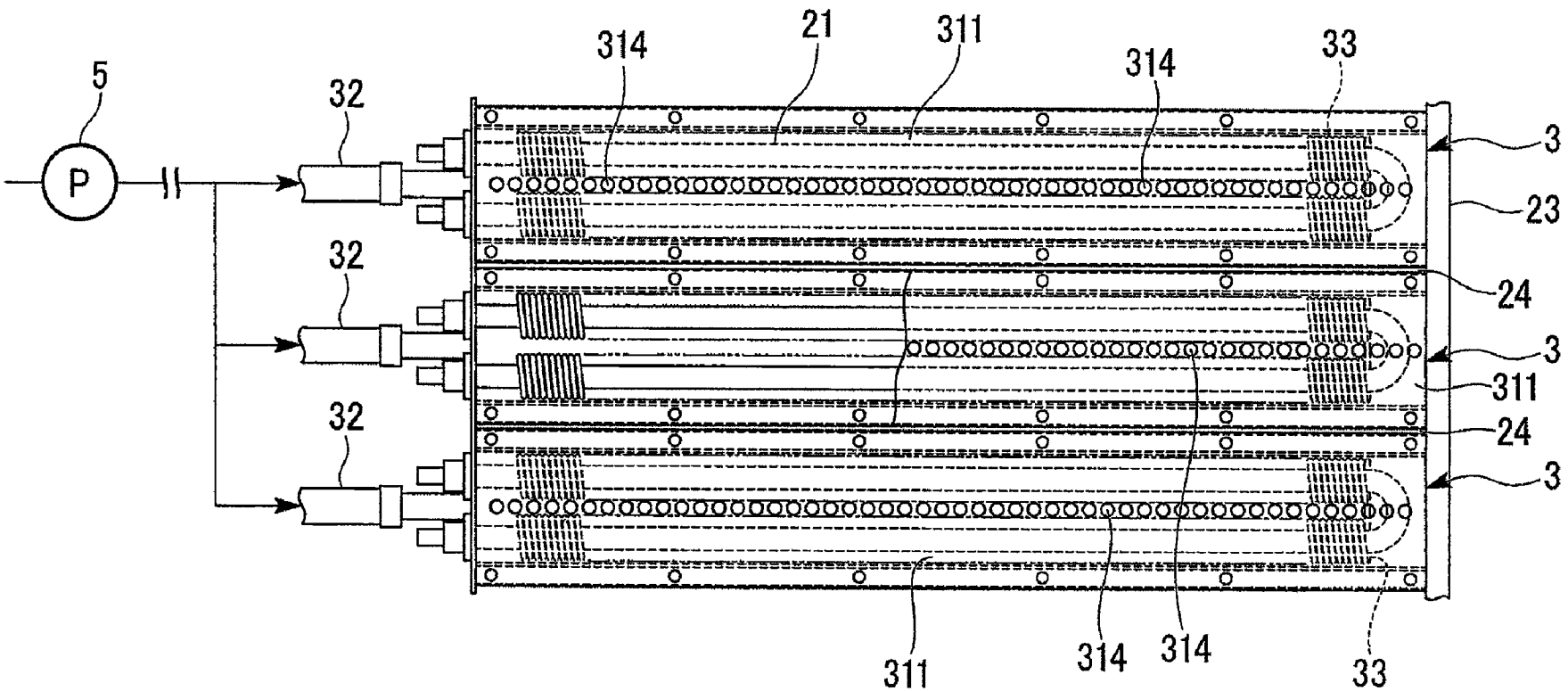
FIG. 6 shows the configuration adopting a round-hole air ejection port formed on the hot-air-blower unit.

It should be noted that the air ejection ports 313 not limited to slits may be round holes 314 or polygonal holes as show in FIG. 6. FIG. 6 shows an example configured to adopt the round holes 314 in place of the slits.

The slit-shaped air ejection ports 313 that can facilitate the positioning of the air ejection ports 313 among the hot-air-blower units 3 are more advantageous than the round holes 314 of the air ejection ports 313 of the hot-air-blower units 3 formed in the staggered arrangement for providing uniform toner-fixing treatment using the hot air blowing onto the full surface of the web 101.

Another conceivable configuration in place of arranging the air ejection ports 313 on the virtual line defined along the air ejection plate 311 may be forming a plurality of slits or micro-holes having the function of the air ejection port 313 on the full surface of the air ejection plate 311.

In terms of maintaining the temperature of the hot air blown onto the web 101 at a stable degree, it is preferable that the enclosure 31 have a capability of confining the heat of the hot air thereinside for minimizing the hot air blowing out of the air ejection ports 313 in view of the heat-confining capability of the enclosure 31. The configuration shown in FIGS. 4 and 6 is advantageous in terms of the stable temperature control for the hot air because the air ejection ports 313 are arranged on a line on the air ejection plate 311.

As show in FIG. 2, an enclosure cover 41 attached to the apparatus main unit 2 accommodates the hot-air-blower unit 3 while fully covering the opposite side of the apparatus main unit 2 with respect to the web-opposing plane 21. The enclosure cover 41 has a recessed shape allowing all the hot-air-blower units 3 provided in the apparatus main unit 2 to be accommodated thereinside so that the outer periphery of the enclosure cover 41 makes contact with the frame 11 disposed around the apparatus main unit 2.

The apparatus main unit 2 has gaps 24 (air exhaust ports) obtained among the adjacent hot-air-blower units 3. The gaps 24 communicate to an air outtake space 42 obtained within the enclosure cover 41. Suctioning the air existing in the air outtake space 42 by using a suction force provided by a suction apparatus (air pump) through an air-outtake duct 43 connected to the enclosure cover 41 allows suctioning of the air existing in the apparatus main unit 2 on the web-opposing plane 21.

The enclosure cover 41 has the function of the air-exhaust section according to the present invention.

In addition, hereinafter, the gaps 24 among the adjacent hot-air-blower unit 3 are called air exhaust ports.

If three or more hot-air-blower units 3 are provided, the apparatus main unit 2 has a plurality of air exhaust ports 24 (gaps).

The toner-fixer apparatus 1 provides smooth air exhaust from between the apparatus main unit 2 and the web 101 by suctioning the hot air, blown onto the web 101 from the air ejection ports 313 formed on the hot-air-blower unit 3, through the air exhaust ports 24.

This prevents the hot air supplied between the apparatus main unit 2 and the web 101 from remaining between the apparatus main unit 2 and the web 101, thereby, providing reliable air convention and thermal efficiency. This results in effective toner fixing treatment based on the shortened time for removing the dried carrier liquid from the web 101.

The air ejection ports 313 distributed in a plurality of spots and facing the web-opposing plane 21 of the apparatus main unit 2 allows uniform hot-air to be blown onto the web 101 with respect to the width direction of the web 101.

Each air exhaust port 24 extending over the width direction (horizontal direction orthogonal to the extending direction as shown in FIG. 3) of the web-opposing plane 21 of the apparatus main unit 2 has a slit shape. In addition, the air exhaust ports 24 provided in the plurality of points in the extending direction of the web-opposing plane 21 (vertical direction on FIG. 3) of the apparatus main unit 2 provide smooth exhaust of the hot air from the central part of the web-opposing plane 21 of the apparatus main unit 2.

Improved air convention between the apparatus main unit 2 and the web 101 prevents dispersion of the evaporated component of the toner and provides effective collection thereof, thereby, maintaining clean condition in the electronic photograph printer 1A.

Improved air convention and thermal efficiency without increasing the temperature of the hot air provide reliable toner-fixing capability. This prevents residual heat from providing wrinkle or slack on the web 101. Inconvenient and instable feed movement of the web 101 which may be caused by the wrinkle or the slack will hardly occur, thus, the feed movement for the web can be stable.

Improved air convention and thermal efficiency can reduce the size of the toner-fixer apparatus relative to that of a conventional apparatus. This facilitates saving of the space.

Consequently, this facilitates reducing of the size of the electronic photograph printer having the toner-fixer apparatus.

In addition, the electronic photograph printer 1A according to the present invention is advantageous for downsizing and space-saving for the electronic photograph printer because the feeding direction of the web 101 passing through the vertical multi-staged electronic-photograph-printing unit 12 is in the longitudinal direction while the feeding direction of the web 101 along the toner-fixer apparatus 1 is reversed with respect to the feeding direction of the web 101 passing through the vertical multi-staged electronic-photograph-printing unit 12; therefore, a significant distance is not necessary between the vertical multi-staged electronic-photograph-printing unit 12 and the toner-fixer apparatus 1.

In addition, increasing the length of the toner-fixer apparatus 1 extending along the web 101 will not cause the vertical multi-staged electronic-photograph-printing unit 12 to be disposed to have a significant distance from the toner-fixer apparatus 1; therefore, the present invention is advantageous in terms of downsizing and space-saving.

In addition, the toner-fixer apparatus 1 of the electronic photograph printer 1A includes vertically-arranged rolls 131 and 132 as shown in FIG. 1 and a cooling apparatus 17 for cooling the rolls 131 and 132.

The configuration adoptable for the rolls 131 and 132 may be cooling rolls that must be provided with connection ports which are connected to water flow pipes for cooling use. In addition, the cooling apparatus 17 (cooling-water-supply apparatus) supplies cooling water to the rolls 131 and 132.

Cooling the roll 132 located downstream relative to the toner-fixer apparatuses 1*a* and 1*b* in the web-feeding direction provides more effective removal of the residual heat remaining on the surface of the web having undergone the toner-fixing treatment by means of hot-air-blow, thereby minimizing the wrinkle or the slack due to the residual heat. Accordingly, a minimum amount of inconvenient and instable feed movement of the web 101 may be caused by the wrinkle or the slack, thus, the feed movement for the web can be stabilized.

In addition, heating up of the roll 132 itself can be prevented.

The roll 131, located upstream relative to the toner-fixer apparatuses 1*a* and 1*b* in the web-feeding direction and disposed above the toner-fixer apparatus 1, will be subjected to heat (hot air) rising up from the toner-fixer apparatus 1. However, the aforementioned water-flow cooling can minimize inconveniences such as a shortened lifetime of the roll 131 due to heat.

Alternatively, two electronic photograph printers 1A may be used so that the web 101 is fed into one of the electronic photograph printers 1A and then further fed into the other one.

In this case, reversing the web 101 using a turn bar provided between the electronic photograph printers 1A permits duplex printing and duplex toner-fixing onto the web 101.

For example, the duplex printing and duplex toner-fixing can be facilitated for an A4 portrait web because it is narrower than an A3 or A2 size web.

Although the present invention has been described with respect to its preferred embodiments, the present invention is not limited to the embodiments described above. The configuration of the present invention allows for addition, omission, substitution and further modification without departing from the spirit and scope of the present invention.

The present invention is not limited to the electronic photograph printer 1A configured to include the vertical multi-staged electronic-photograph-printing units 12. For example, the electronic photograph printer according to the present invention may include the configuration provided with the electronic-photograph-printing unit 12 as a single unit.

Alternatively, the arrangement for the plurality of electronic-photograph-printing units, not limited to the vertical multi-staged configuration, can be arbitrarily modified. More importantly, the vertical multi-staged electronic-photograph-printing units 12 are advantageous in terms of space-saving.

The present invention is not limited to the aforementioned embodiments configured to feed the web 101 in the vertical multi-staged electronic-photograph-printing unit 12 in the upward direction and to further feed the web 101 downward along the toner-fixer apparatus 1. An adoptable alternative configuration may feed the web 101 in the vertical multi-staged electronic-photograph-printing unit 12 in the downward direction and to further feed the web 101 in the upward direction along the toner-fixer apparatus 1.

The cooling apparatus for cooling the roll 132 located downstream relative to the toner-fixer apparatuses 1*a* and 1*b* in the web-feeding direction may not be limited to a cooling-water-supply apparatus. Another adoptable example may be an air-cooling apparatus for supplying cooling air to the roll 132.

The number of toner-fixer apparatuses installed in the electronic photograph printer may be one or not less than two in place of the aforementioned embodiments showing the electronic photograph printer having the two vertically-arranged toner-fixer apparatuses 1*a* and 1*b*.

The specifications of the hot-air-blower section and the air-exhaust section are not limited to the aforementioned embodiments. The air-exhaust section may adopt a configuration, for example, in which exhaust ducts are connected separately among the hot-air-blower units.

For example, the present invention may adopt a configuration in which a plurality of hot-air-blower sections are provided in the width direction of the apparatus main unit so that gaps formed between the adjacent hot-air-blower sections disposed in the width direction of the apparatus main unit can be air exhaust ports in contrast to the aforementioned embodiments adopting the configuration in which the hot-air-blower unit has the longitudinal length extending over the width (horizontal directions as shown in FIGS. 3 and 4) of the apparatus main unit.

What is claimed is:

1. A toner-fixer apparatus used in a wet electronic photograph printer using developing solution including liquid toner and carrier liquid, the toner-fixer apparatus comprising:

an apparatus main unit extending along a web fed in the electronic photograph printer;

a hot-air-blower section having air ejection ports for blowing hot air therefrom onto the web; and an air-exhaust section having air exhaust ports having openings opposed to the web fed in the apparatus main unit, wherein the air-exhaust section is configured to suction air through the air exhaust ports and to discharge suctioned air outside of the apparatus main unit;

the hot-air-blower section includes a plurality of hot-air-blower units provided in the apparatus main unit;

each of the hot-air-blower units comprises:

an enclosure having an air ejection port;

air-supply piping provided in the enclosure; and a heater provided in the enclosure for heating air supplied into the enclosure from the air-supply piping; and the heater is disposed so as to be separated from the air ejection port in a direction parallel to a surface of the web.

2. The toner-fixer apparatus according to claim 1, wherein the air ejection ports and the air exhaust ports are located at a plurality of points opposed to the web fed in the apparatus main unit.

3. The toner-fixer apparatus according to claim 2, wherein the air-exhaust section suctions air through the air exhaust ports having a slit-shape formed among the hot-air-blower units provided in the apparatus main unit.

4. The toner-fixer apparatus according to claim 2, further comprising two web-guiding rolls, disposed in the vicinity of two ends of the longitudinal length of the apparatus main unit, wherein at least one roll of the web-guiding rolls, disposed downstream relative to the apparatus main unit in a direction for feeding the web has a cooling apparatus for cooling the one roll.

5. The toner-fixer apparatus according to claim 2, further comprising a support shaft for rotatably supporting the apparatus main unit of the electronic photograph printer so that the apparatus main unit can be rotated against the web.

6. An electronic photograph printer comprising the toner-fixer apparatus according to claim 2.

7. The toner-fixer apparatus according to claim 1, wherein the air-exhaust section suctions air through the air exhaust ports having a slit-shape formed among the hot-air-blower units provided in the apparatus main unit.

8. The toner-fixer apparatus according to claim 7, further comprising two web-guiding rolls, disposed in the vicinity of two ends of the longitudinal length of the apparatus main unit, wherein at least one roll of the web-guiding rolls, disposed downstream relative to the apparatus main unit in a direction for feeding the web has a cooling apparatus for cooling the one roll.

9. The toner-fixer apparatus according to claim 7, further comprising a support shaft for rotatably supporting the apparatus main unit of the electronic photograph printer so that the apparatus main unit can be rotated against the web.

10. An electronic photograph printer comprising the toner-fixer apparatus according to claim 7.

11. The toner-fixer apparatus according to claim 1, further comprising two web-guiding rolls, disposed in the vicinity of two ends of the longitudinal length of the apparatus main unit, wherein at least one roll of the web-guiding rolls, disposed downstream relative to the apparatus main unit in a direction for feeding the web has a cooling apparatus for cooling the one roll.

12. The toner-fixer apparatus according to claim 11, further comprising a support shaft for rotatably supporting the apparatus main unit of the electronic photograph printer so that the apparatus main unit can be rotated against the web.

13. An electronic photograph printer comprising the toner-fixer apparatus according to claim 11.

14. The toner-fixer apparatus according to claim 1, further comprising a support shaft for rotatably supporting the apparatus main unit of the electronic photograph printer so that the apparatus main unit can be rotated against the web.

15. An electronic photograph printer comprising the toner-fixer apparatus according to claim 14.

16. An electronic photograph printer comprising the toner-fixer apparatus according to claim 1.

17. The electronic photograph printer according to claim 16, further comprising vertical multi-staged electronic-photograph-printing units for conducting printing operations onto the web, wherein the web passed through the vertical multi-staged electronic-photograph-printing unit and fed in vertical direction has a downstream section from which the feeding direction of the web is reversed, and the toner-fixer apparatus is disposed along the web so that the downstream section of the web is introduced into the toner-fixer apparatus.

18. The toner-fixer apparatus according to claim 1, wherein the air-supply piping is configured to supply air along a direction parallel to a surface of the web.

* * * * *